US006467533B1

(12) United States Patent
Murakami et al.

(10) Patent No.: US 6,467,533 B1
(45) Date of Patent: Oct. 22, 2002

(54) MACHINE AND METHOD FOR CONTINUOUS CASTING OF STEEL

(75) Inventors: Toshihiko Murakami, Kashima; Masahiko Oka, Ikeda; Hirohisa Kikuchi, Amagasaki; Atsushi Murata, Osaka; Takashi Usui, Kobe, all of (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/694,263

(22) Filed: Oct. 24, 2000

(30) Foreign Application Priority Data

Oct. 28, 1999 (JP) ..... 11-307629

(51) Int. Cl.[7] ..... B22D 11/128; B22D 11/12
(52) U.S. Cl. ..... 164/484; 164/442; 164/418
(58) Field of Search ..... 164/484, 442, 164/441, 418

(56) References Cited

U.S. PATENT DOCUMENTS 3,729,048 A * 4/1973 Gelfenbein et al. ..... 164/282
3,893,503 A * 7/1975 Eibl ..... 164/282
3,938,584 A * 2/1976 Meylan ..... 164/283
4,501,314 A * 2/1985 Wakabayashi et al. ..... 164/441
5,031,687 A * 7/1991 Bollig et al. ..... 164/442
5,343,934 A * 9/1994 Wilson ..... 164/476
5,601,138 A * 2/1997 Di Giusto et al. ..... 164/452

FOREIGN PATENT DOCUMENTS

JP 61-150760 7/1986

* cited by examiner

*Primary Examiner*—M. Alexandra Elve
*Assistant Examiner*—Len Tran
(74) *Attorney, Agent, or Firm*—Armstrong, Westerman, & Hattori, LLP

(57) ABSTRACT

Among the slab-supporting guide roll pairs disposed in the region in which a liquid core exists within the slab, at least four consecutive guide roll pairs are disposed under such conditions that the roll axis-to-axis distances on the fixed side and loose side of the guide roll pairs and the roll halfway-to-halfway distances on the fixed side and loose side are all different from one another. Casting is carried out while disposing the guide roll pairs under sucb conditions.

14 Claims, 1 Drawing Sheet

MACHINE AND METHOD FOR CONTINUOUS CASTING OF STEEL

This application claims priority under 35 U.S.C. §§119 and/or 365 to Japan Patent Application No.11-307629 filed in Japan on Oct. 28, 1999, the entire content of which is herein incorporated by references.

BACKGROUND OF THE INVENTION

1. Technical Field

The present invention relates to a machine for continuous casting of steel and a method for continuous casting of steel, by which the occurrence of periodical molten steel level fluctuations in a mold, as caused by slab bulging can be prevented and good-quality slabs, which have no surface defects due to mold powder trapping and no longitudinal surface cracks, can be obtained.

2. Background Art

In continuous casting, a slab is supported and guided by a plurality of guide roll pairs and withdrawn by pinch roll pairs. However a slab between the guide roll pairs is not supported, therefore, a bulging occurs in the slab which contains a liquid core. When the bulged portion of the slab passes through a next downstream guide roll pair, the portion having an increased thickness due to bulging undergoes reduction by the paired guide rolls.

When the slab bulges, some portion of liquid core molten steel in the upstream side relative to the bulged portion flows into the bulged portion and, when the bulged portion undergoes reduction by rolls, some portion of molten steel in the bulged portion is pressed back to the upstream side accordingly. When the amount of liquid core molten steel flowing from the upstream side into the bulged portion and the amount of liquid core molten steel subsequently pressed back from the bulged portion to the upstream side are constant with the lapse of time, no periodic molten steel level fluctuations occur in the mold.

However, the slab solidification is uneven in the direction of casting as well as in the direction of slab width, and the bulging-caused flow of molten steel is also uneven. As a result, the extent of bulging varies not only in the direction of the casting but also varies with the lapse of time even at the same place. Therefore, the amount of liquid core molten steel flowing from the upstream side into the bulged portion and the amount of molten steel pressed back from the bulged portion to the upstream side are not always equal upon each repetition of slab bulging and reduction of the bulged portion, so that periodical molten steel level fluctuations, which are up and down fluctuations of the molten metal level within the mold, occur.

Further, when, in guide roll pairs, the roll-to-roll distances in the direction of casting are the same, but the periodical molten steel level fluctuations within the mold are enhanced and become greater. The extent, per occurrence, of bulging occurring between two neighboring rolls is generally several hundred micrometers and, therefore, even when the bulged portion returns to the original thickness before bulging as a result of reduction by the next downstream side rolls, the fluctuations in the amount of liquid core molten steel flowing into from the upstream side and pressed back are small, hence the periodic molten steel level fluctuations within the mold are slight. However, in cases where the roll-to-roll distances for many guide roll pairs are the same, the molten steel level fluctuations due to bulging become periodic and great fluctuations. The periodical molten steel level fluctuations due to ordinary bulging generally amount to about ±2.5 to ±10 mm vertically at the reference level.

Where the magnitude of periodical molten steel level fluctuations is great, the mold powder may be entrapped in the molten steel in the mold, causing the occurrence of defects on the slab surface, due to mold powder trapping, or longitudinal cracks on the slab surface. Furthermore, when the periodic molten steel level fluctuations is particularly great, the operation may become difficult to continue.

Concerning the prevention of such periodic molten steel level fluctuations within mold as resulting from slab bulging, a method is proposed in JP Kokai (Laid-Open Unexamined Japanese Patent Application) S61-150760 which comprises disposing the guide rolls at non-uniform positions which are asymmetrical on the right and left.

However, this method may allow the occurrence of periodic molten steel level fluctuations within a mold as caused by slab bulging particularly when thin slabs having a thickness of 50 to 120 mm are cast at a high speed of about 3 to 5 m/min. Under the current situation of actual operation, the casting speed is slowed down to thereby suppress the occurrence of molten steel level fluctuations in cases where the periodic molten steel level fluctuations become intense and make it difficult to continue the operation.

In recent- years, such a continuous casting method for producing slabs having a thin thickness of 50 to 120 mm at a speed of about 3 to 5 m/min has been the target of development efforts from the viewpoint of reducing the cost of construction of associated equipment and reducing the personnel Under such circumstances, a method has been put to practical use according to which the continuous casting of thin slabs is combined with the rolling on a simple hot roll machine disposed on the continued casting line.

It is an object of the present invention to provide a machine for continuous casting of steel and a method of continuous casting of steel which prevent the occurrence of periodic molten steel level fluctuations in a mold as caused by slab bulging and make it possible to obtain good-quality slabs which have no defects in the slab surface as may be caused by mold powder trapping and no longitudinal cracks on the slab surface.

SUMMARY OF THE INVENTION

It is known that periodical molten steel level fluctuations in mold as caused by slab bulging occur in ordinary slabs about 250 mm in thickness. In the casting process, which have recently been put to practical use, for producing thin slabs having a thickness of 50 to 120 mm at a high speed of 3 to 5 m/min, periodical molten steel level fluctuations tend to occur more easily.

When thin slabs having a thickness of 50 to 120 mm are cast at a high speed of 3 to 5 m/min. the slab, just after withdrawal from the mold, has a thin solidifying shell and a thick liquid core. Therefore, slab bulging is apt to occur and, furthermore, since the sectional area of the mold is small, the molten steel level in the mold is readily influenced by the flow of liquid core molten steel flowing from the upstream side into the bulged portion, and by the flow of molten steel pressed back from the bulged portion to the upstream side.

Machine and method for continuous casting of steel of the present invention are a machine and a method intended to prevent periodic molten steel level fluctuations in a mold, as is caused by slab bulging.

The machine for continuous casting of steel of the invention is a machine in which, among the slab-supporting guide roll pairs disposed in the region in which the slab withdrawn from the mold contains a liquid core therewithin, at least four consecutive guide roll pairs are disposed under such conditions that the roll axis-to-axis distances (distances between two points in the central axis of the rolls) on the fixed side and loose side of the guide roll pairs and the roll halfway-to-halfway distances (distances between halfway of the rolls) on the fixed side and loose side, as determined in the direction of casting, are all different from one another.

By using this continuous casting machine, it is possible to prevent the occurrence of periodic molten steel level fluctuations in the mold as is caused by slab bulging and obtain good-quality slabs which have no slab surface defects caused by mold powder trapping and no longitudinal cracks.

The method for continuous casting of steel of the invention is a method which comprises carrying out the casting under such conditions that, among the slab-supporting guide roll pairs disposed in the region in which the slab withdrawn from the mold contains a liquid core therewithin, at least four consecutive guide rolls pairs are disposed so that the roll axis-to-axis distances on the fixed side and loose side and the halfway-to-halfway distances on the fixed side and loose side, as determined in the direction of casting, are all different from one another.

By applying this continuous casting method, it is possible to prevent the occurrence of periodical molten steel level fluctuations in mold as caused by slab bulging and obtain good-quality slabs without the occurrence of slab surface defects caused by mold powder trapping and longitudinal cracks.

DETAILED DESCRIPTION OF THE INVENTION

Figure 1:
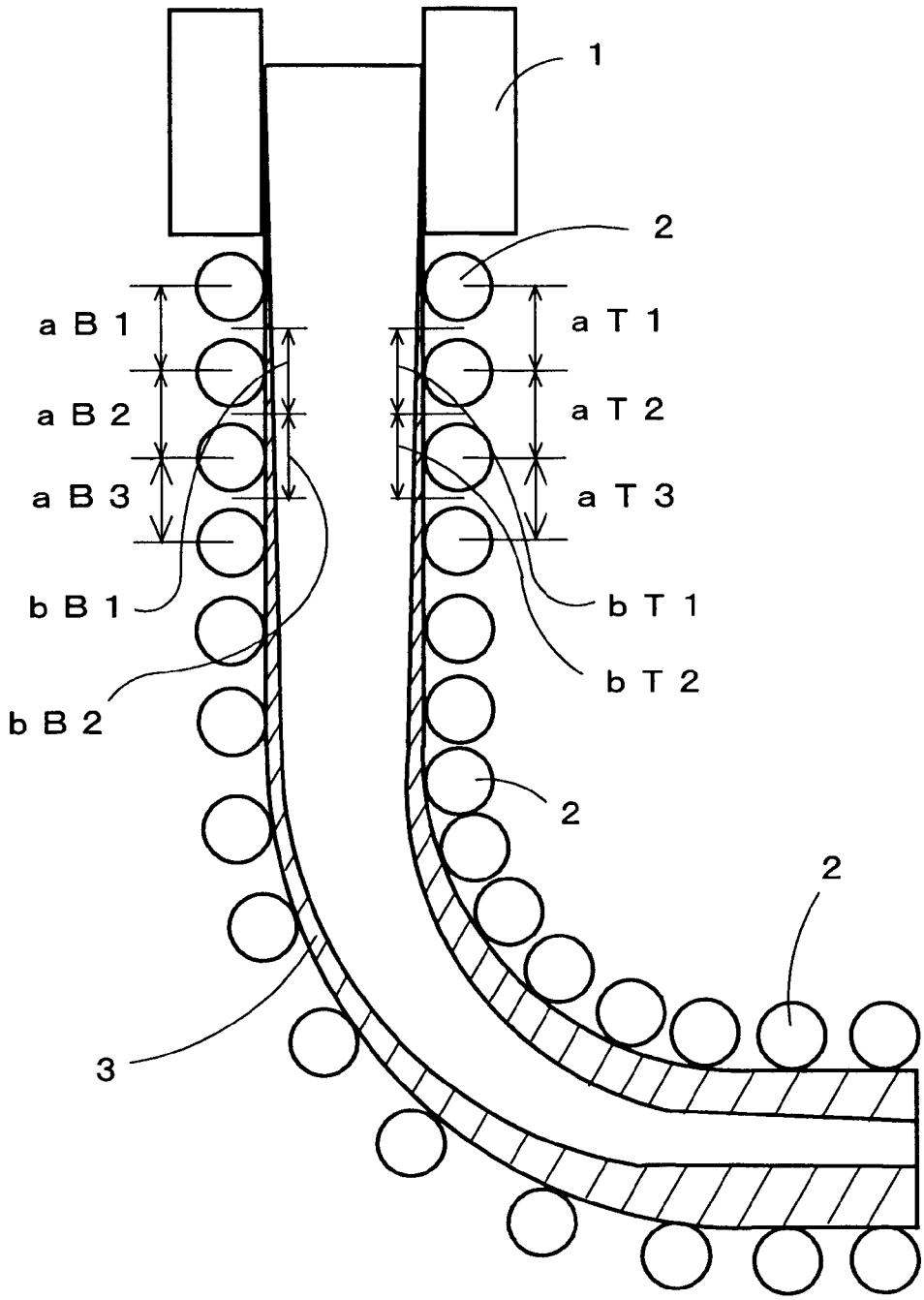
FIG. 1 is a schematic representation of guide roll pairs disposition for illustrating the roll axis-to-axis distances and roll halfway-to-halfway distances to be defined in accordance with the present invention.

The continuous casting machine for which the machine and method of the present invention are applied is a vertical-bending type continuous casting machine or a curved type continuous casting machine.

First, the axis-to-axis distance of guide roll pairs and the halfway-to-halfway distance between rolls are explained.

FIG. 1 is a schematic representation of guide roll pairs arrangement for illustrating the roll axis-to-axis distances and roll halfway-to-halfway distances to be defined in accordance with the present invention, There is shown a part of the guide roll pairs arrangement in the case of a vertical-bending type continuous casting machine. The figure shows that a slab 3 withdrawn from just below the lower end of a mold 1 is supported and guided by guide roll pairs, each of which is constituted by two opposing rolls. The "fixed side", so referred to herein, means the side of the rolls disposed below the slab in the horizontal part and, in the vertical part, the side of rolls disposed on the left side on the drawing page, and the "loose side", so referred to herein, means the side where rolls are on the upper side in the horizontal part and, in the vertical part, the side of rolls disposed on the right side on the drawing page.

The fixed side roll axis-to-axis distances mean the central axis-to-central axis distances between respective neighboring rolls on the fixed side, such as those indicated by the symbols aB1, aB2 and aB3 in FIG. 1, and the loose side roll axis-to-axis distances mean the central axis-to-central axis distances between respective neighboring rolls on the loose side, such as those indicated by the symbols aT1, aT2 and aT3.

The fixed side roll halfway-to-halfway distances mean the distances between the halfway points from the central axes of respective neighboring rolls on the fixed side, such as those indicated by the symbols bB1 and bB2 in FIG. 1. The loose side roll halfway-to-halfway distances mean the distances between the halfway points from the central axes of respective neighboring rolls on the loose side, such as those indicated by the symbols bT1 and bT2 in FIG. 1.

Then, the possibility of preventing periodic molten steel level fluctuations in a mold, as caused by slab bulging, by applying the machine and method for continuous casting of steel of the present invention is explained below under (a) and (b).

(a) In casting the thin slabs which have a thickness of 90 mm and a width of 1,000 mm at a casting speed of 3 to 5m/min, the tendency toward the occurrence of periodic molten steel level fluctuations is remarkable and the periodic molten steel level fluctuations tend to occur to the region in which a liquid core exists in the slab and when the same distance value or distance values exist among the roll axis-to-axis distances and roll halfway-to-halfway distances for at least four consecutive guide roll pairs.

It was found that even when the roll axis-to-axis distances for at least four guide roll pairs are made all different from one another and the rolls on the fixed side and those on the loose side are disposed in asymmetrical positions, molten steel level fluctuations do occur, if there exist the same distance value or distance values among the roll halfway-to-halfway distances.

Namely, when a thin slab about 90 mm in thickness is cast at a high speed of 3 to 5 m/min, slab bulging is apt to occur and, when, on that occasion, the same distance value or distance values exist among the roll axis-to-axis distances and roll halfway-to-halfway distances for at least four consecutive guide roll pairs, the molten steel level in the mold which is small in sectional area is readily influenced by the molten steel flow of liquid core molten steel flowing from the upstream side into the bulged portion and flowing from the bulged portion to the upstream side.

As to the dependence of the tendency toward occurrence of molten steel level fluctuations on the position, in the region in which a liquid core exists beginning from just below the mold, of at least four guide roll pairs for which the same distance value or distance values exist among the roll axis-to-axis distances and roll halfway-to-halfway distances, the tendency varies depending on the casting conditions, such as the steel grade to be cast and the casting speed.

(b) In the continuous casting machine according to the invention, at least four consecutive guide roll pairs disposed in the region in which the slab withdrawn from the mold contains a liquid core therewithin have such axis-to-axis distances and halfway-to-halfway distances that are all different from one another, and the continuous casting method according to the invention uses such machine, and, as a result, those periodic molten steel level fluctuations which are caused by slab bulging can be prevented from occurring.

The position, on the fixed side and loose side, of at least four consecutive guide roll pairs for which the roll axis-to-axis distances and roll halfway-to-halfway distances are all different from one another may be selected at an appropriate place according to the casting conditions such as the steel grade to be cast and the casting speed.

That the roll axis-to-axis distances and roll halfway-to-halfway distances are different from one another means that these difference values differ by not less than 0.5 mm. It is more desirable that the distances differ by 3 to 6 mm.

In the following, the machine and method for continuous casting of steel of the invention are collectively described more specifically.

In the machine and method of the invention, it is only required that the roll axis-to-axis distances and roll halfway-to-halfway distances of at least four consecutive guide roll pairs are all different from one another. Among the rolls belonging to other guide roll pairs than at least four consecutive guide roll pairs, there may exist the same roll axis-to-axis or roll halfway-to-halfway distance or distances.

In the machine and method of the invention, it is desirable that at least four consecutive guide roll pairs be disposed under such conditions that the roll axis-to-axis distances on the fixed side of the guide roll pairs gradually increase from the upstream side to the downstream side in the direction of casting while the roll axis-to-axis distances on the loose side gradually decrease, or under such conditions that the roll axis-to-axis distances on the fixed side gradually decrease while the roll axis-to-axis distances on the loose side gradually increase. It is possible to render the roll axis-to-axis distances and roll halfway-to-halfway distances on the fixed side and the roll axis-to-axis distances and roll halfway-to-halfway distances on the fixed side and the roll axis-to-axis distances and roll halfway-to-halfway distances on the loose side of at least four consecutive guide roll pairs all different from one another in an effective manner.

Further, in the machine and method of the invention, it is more desirable that consecutive guide roll pairs be disposed under such conditions that, in gradually increasing or decreasing the roll axis-to-axis distance on the fixed side or loose side of the guide roll pairs, the axis-to-axis distance value of the first guide roll pair in a group of consecutive guide roll pairs is put back to a value between the axis-to-axis distance value of the first guide roll pair and the axis-to-axis distance value of the last guide roll pair in a former group of consecutive guide roll pairs. It is possible to render the roll axis-to-axis distances on the fixed side and loose side and the roll halfway-to-halfway distances on the fixed side and loose side of more than four consecutive guide roll pairs all different from one another.

The machine and method of the invention are favorably applied in casting low-carbon aluminum-killed steel having a C content of less than 0.07% by mass and peritectic steel having a C content of 0.07% by mass to 0.18% by mass. They are further favorably applied in casting slabs having a thickness of 50 mm to 120 mm. In casting steel having such a C content or slabs having such a thickness, periodic molten steel level fluctuations are apt to occur. By applying the machine and method of the invention, however, it is possible to effectively prevent periodic molten steel level fluctuations from occurring.

Further, in the machine and method of the invention, it is recommended that the position of at least four consecutive guide roll pairs for which the roll axis-to-axis distances and roll halfway-to-halfway distances are all different from one another be selected at an appropriate place according to the casting conditions, such as the steel grade to be cast and the casting speed. More specifically, it is recommend that the relation between the position of at least four consecutive guide roll pairs and the steel grade and casting speed be considered to be as mentioned below. The number of guide roll pairs in the region in which a liquid core exists within the slab withdrawn from the mold is about 30 to 40, although the number may vary depending on the continuous casting machine species.

Thus, in cases where peritectic steel with a C content of 0.07 to 0.18% by mass is cast at a speed of 3 to 4 m/min, it is recommended that the roll axis-to-axis distances and roll halfway-to-halfway distances for at least four consecutive guide roll pairs located in the region from the exit of the mold to 5 meters from the meniscus in the mold be all made differently from one another.

When low-carbon aluminum-killed steel with a C content of less than 0.07% by mass is cast at a speed of 4 to 5 m/min, it is recommended that the roll axis-to-axis distances and roll halfway-to-halfway distances for as many guide roll pairs as possible in the region where a liquid core exists from just below the mold be all rendered different from one another.

In the next place, a concrete method of roll disposition for rendering the roll axis-to-axis distances and roll halfway-to-halfway distances on the fixed side and the roll axis-to-axis distances and roll halfway-to-halfway distances on the loose side of at least four consecutive guide roll pairs all different from one another is described.

For instance, the guide roll pair just below the exit of the mold is numbered 1. For gradually increasing the roll axis-to-axis distance for m guide roll pairs from the first guide roll pair to the m-th guide roll pair on the fixed side in the direction of casting and gradually decreasing the roll axis-to-axis distance on the loose side, the following method is recommended.

First, a method of gradually increasing the roll axis-to-axis distance from the k-th guide roll pair on the fixed side to the n-th guide roll pair on the fixed side (provided that $k<n<m$) is as follows. Thus, the distance of the k-th guide roll pair on the fixed side from the meniscus in the mold is represented by (Lk), the distance of the (k+1)-th guide roll pair on the downstream side thereof on the fixed side from the meniscus by (Lk+1) and, likewise, the distance of the (n−1)-th guide roll pair on the fixed side from the meniscus in the mold by (Ln−1) and the distance of the n-th guide roll pair on the downstream side thereof on the fixed side from the meniscus by (Ln). In that case, the distance between two points in central axis of rolls, namely roll axis-to-axis distance, between the k-th and (k+1)-th rolls and that between the (n−1)-th and n-th rolls should have respective roll axis-to-axis distance values satisfying the relations represented by the formulas (A), (B) and (C) given below. In this way, the roll axis-to-axis distance can be gradually increased from the k-th to the n-th rolls on the fixed side.

According to the above method, the roll axis-to-axis distances can be selected for the first to the (k−1)-th roll and from the (n+1)-th to the m-th rolls on the fixed side by selecting the p value and α value so that the respective roll axis-to-axis distances for the rolls on the fixed side may be different from one another.

$$(Lk+1)-(Lk)=p+2\times\alpha \quad \text{(A)}$$

$$(Ln)-(Ln-1)=p+(n-k+1)\times\alpha \quad \text{(B)}$$

$$\alpha=\{G-(n-k)\times(p+\alpha)\}/\{(n-k)+(n-k-1)+\ldots+1\} \quad \text{(C)}$$

where, p: an arbitrary constant not less than Dk (mm),

Dk: the diameter of the larger roll of the k-th and (k+1)-th fixed side rolls (mm), α: an integer determined from the above formula (C) (mm), and G: $[\{(Lk+1)-(Lk)\}+\ldots+\{(Ln)-(Ln-1)\}]$ (mm).

Next, a method of gradually decreasing the roll axis-to-axis distance from the k-th guide roll pair to the n-th guide roll pair ($k<n<m$) on the loose side is, like the above-mentioned method of gradually increasing, as follows. Thus, the distance of the k-th roll n the loose side from the meniscus in the mold is represented by (Rk), the distance of the (k+1)-th roll on the downstream side thereof on the loose side from the meniscus by (Rk+1), the distance of the (n−1)-th roll on the loose side from the menqiscus in the mold by (Rn−1) and the distance of the n-th roll on the downstream side thereof on the loose side from the meniscus by (Rn) In that case, the distance between two points in central axis of rolls, namely the roll axis-to-axis distance, between the k-th and (k+1)-th rolls and that between the (n−1)-th and n-th rolls should have respective roll axis-to-axis distance values satisfying the relations represented by the formulas (D), (E) and (F) given below. In this way, the roll axis-to-axis distance can be gradually decreased from the k-th to the n-th roll on the loose side.

According to the above method, the roll axis-to-axis distances can be selected for the first to the (k−1)-th guide roll pair from the (n+1)-th to the m-th guide roll pair on the loose side by selecting the p value and α value so that the respective roll axis-to-axis distances for the rolls on the loose side may be different from one another.

$$(Rk+1)-(Rk)=p+(n-k)\times\alpha \quad \text{(D)}$$

$$(Rn)-(Rn-1)=p+1\times\alpha \quad \text{(E)}$$

$$\alpha=\{G\times(n-k)\times p\}/\{(n-k)+(n-k-1)+\ldots+1\} \quad \text{(F)}$$

where, p: an arbitrary constant not less than Dk (mm),

Dk: the diameter of the larger roll of the k-th and (k+1)-th loose side rolls (mm), α: an integer determined from the above formula (F) (mm), and G: [{(Rk+1)−(Rk)}+ . . . +{(Rn)−(Rn−1)}] (mm).

An example is shown in Table 1 of the roll disposition for guide rolls where the roll axis-to-axis distances and roll halfway-to-halfway distances of not less than four and as many as possible consecutive guide roll pairs are made different from one another in the region in which a liquid core exists inside the slab withdrawn from the mold. This is an example for a vertical bending type continuous casting machine having a vertical length of 1.5 m, a bending radius of 3.5 m and a distance of the unbending point from the meniscus of 8.4 m. In gradually increasing the roll axis-to-axis distance on the fixed side of guide roll pairs and gradually decreasing the roll axis-to-axis distance on the loose side, the above formulas (A) to (F) were utilized and the rolls of the first guide roll pair just below the exit of the mold to the 38th guide roll pair at the unbending point were disposed.

In this example, as regards the 12 guide roll pairs from No. 1 just below the mold to No. 12, all the roll axis-to-axis distances and roll halfway-to-halfway distances are different from one another except that the roll halfway-to-halfway distance for No. 5 on the fixed side and the roll axis-to-axis distance for No. 11 on the loose side are both equal to 162.0 mm. The No. 11 guide roll pair is the 6th of the consecutive guide roll pairs from the No. 5 guide roll pair.

TABLE 1

| | Fixed side rolls (mm) | | | | | | Loose side rolls (mm) | | | | | |
|---|---|---|---|---|---|---|---|---|---|---|---|---|
| Guide roll No. | Roll diameter | Axis-axis distance* | Halfway-halfway distance* | p value | α value | Distance from meniscus | Roll diameter | Axis-axis distance* | Halfway-halfway distance* | p value | α value | Distance from meniscus |
| 1 | 110 | — | — | — | — | 890 | 110 | — | — | — | — | 890 |
| 2 | 120 | 144.0 | 146.5 | 139 | 5 | 1034 | 120 | 160.0 | 157.5 | 140 | 5 | 1050 |
| 3 | 120 | 149.0 | 151.5 | 139 | 5 | 1183 | 120 | 155.0 | 152.5 | 140 | 5 | 1205 |
| 4 | 120 | 154.0 | 156.5 | 139 | 5 | 1337 | 120 | 150.0 | 147.5 | 140 | 5 | 1355 |
| 5 | 120 | 159.0 | 162.0 | 139 | 5 | 1496 | 120 | 145.0 | 166.0 | 140 | 5 | 1500 |
| 6 | 120 | 165.0 | 167.5 | 160 | 5 | 1661 | 120 | 187.0 | 184.5 | 152 | 5 | 1687 |
| 7 | 120 | 170.0 | 172.5 | 160 | 5 | 1831 | 120 | 182.0 | 179.5 | 152 | 5 | 1869 |
| 8 | 120 | 175.0 | 177.5 | 160 | 5 | 2006 | 120 | 177.0 | 174.5 | 152 | 5 | 2046 |
| 9 | 120 | 180.0 | 182.5 | 160 | 5 | 2186 | 120 | 172.0 | 169.5 | 152 | 5 | 2218 |
| 10 | 120 | 185.0 | 187.5 | 160 | 5 | 2371 | 120 | 167.0 | 164.5 | 152 | 5 | 2385 |
| 11 | 120 | 190.0 | 192.5 | 160 | 5 | 2561 | 120 | 162.0 | 159.5 | 152 | 5 | 2547 |
| 12 | 120 | 195.0 | 180.75 | 160 | 5 | 2756 | 120 | 157.0 | 172.3 | 152 | 5 | 2704 |
| 13 | 140 | 166.5 | 169.5 | 160.5 | 6 | 2922.5 | 140 | 186.5 | 184.5 | 166.5 | 4 | 2890 |
| 14 | 140 | 172.5 | 175.5 | 160.5 | 6 | 3095 | 140 | 182.5 | 180.5 | 166.5 | 4 | 3072.5 |
| 15 | 140 | 178.5 | 181.5 | 160.5 | 6 | 3273.5 | 140 | 178.5 | 176.5 | 166.5 | 4 | 3250 |
| 16 | 140 | 184.5 | 187.5 | 160.5 | 6 | 3458 | 140 | 174.5 | 172.5 | 166.5 | 4 | 3425.5 |
| 17 | 140 | 190.5 | 191.5 | 160.5 | 6 | 3648.5 | 140 | 170.5 | 186.3 | 166.5 | 4 | 3596 |
| 18 | 160 | 192.5 | 195.5 | 186.5 | 6 | 3841 | 160 | 202.0 | 200.0 | 182 | 4 | 3798 |
| 19 | 160 | 198.5 | 201.5 | 186.5 | 6 | 4039.5 | 160 | 198.0 | 196.0 | 182 | 4 | 3996 |
| 20 | 160 | 204.5 | 207.5 | 186.5 | 6 | 4244 | 160 | 194.0 | 192.0 | 182 | 4 | 4190 |
| 21 | 160 | 210.5 | 213.5 | 186.5 | 6 | 4454.5 | 160 | 190.0 | 188.0 | 182 | 4 | 4380 |
| 22 | 160 | 216.5 | 215.75 | 186.5 | 6 | 4671 | 160 | 186.0 | 200.3 | 182 | 4 | 4566 |
| 23 | 170 | 215.0 | 218.0 | 209 | 6 | 4886 | 170 | 214.5 | 212.0 | 189.5 | 5 | 4780.5 |
| 24 | 170 | 221.0 | 224.0 | 209 | 6 | 5107 | 170 | 209.5 | 207.0 | 189.5 | 5 | 4990 |
| 25 | 170 | 227.0 | 230.0 | 209 | 6 | 5334 | 170 | 204.5 | 202.0 | 189.5 | 5 | 5194.5 |
| 26 | 170 | 233.0 | 236.0 | 209 | 6 | 5567 | 170 | 199.5 | 197.0 | 189.5 | 5 | 5394 |
| 27 | 170 | 239.0 | 231.0 | 209 | 6 | 5806 | 170 | 194.5 | 222.3 | 189.5 | 5 | 5588.5 |
| 28 | 190 | 223.0 | 224.5 | 220 | 3 | 6029 | 190 | 250.0 | 248.0 | 206 | 4 | 5838.5 |
| 29 | 190 | 226.0 | 227.5 | 220 | 3 | 6255 | 190 | 246.0 | 244.0 | 206 | 4 | 6084.5 |
| 30 | 190 | 229.0 | 230.5 | 220 | 3 | 6484 | 190 | 242.0 | 240.0 | 206 | 4 | 6326.5 |
| 31 | 190 | 232.0 | 233.5 | 220 | 3 | 6716 | 190 | 238.0 | 236.0 | 206 | 4 | 6564.5 |
| 32 | 190 | 235.0 | 236.5 | 220 | 3 | 6951 | 190 | 234.0 | 232.0 | 206 | 4 | 6798.5 |
| 33 | 190 | 238.0 | 239.5 | 220 | 3 | 7189 | 190 | 230.0 | 228.0 | 206 | 4 | 7028.5 |
| 34 | 190 | 241.0 | 242.5 | 220 | 3 | 7430 | 190 | 226.0 | 224.0 | 206 | 4 | 7254.5 |
| 35 | 190 | 244.0 | 245.5 | 220 | 3 | 7674 | 190 | 222.0 | 220.0 | 206 | 4 | 7476.5 |
| 36 | 190 | 247.0 | 248.5 | 220 | 3 | 7921 | 190 | 218.0 | 216.0 | 206 | 4 | 7694.5 |

TABLE 1-continued

| Guide roll No. | Fixed side rolls (mm) | | | | | | Loose side rolls (mm) | | | | | |
|---|---|---|---|---|---|---|---|---|---|---|---|---|
| | Roll diameter | Axis-axis distance* | Halfway-halfway distance* | p value | α value | Distance from meniscus | Roll diameter | Axis-axis distance* | Halfway-halfway distance* | p value | α value | Distance from meniscus |
| 37 | 190 | 250.0 | 251.5 | 220 | 3 | 8171 | 190 | 214.0 | 212.0 | 206 | 4 | 7908.5 |
| 38 | 190 | 253.0 | 249.0 | 220 | 3 | 8424 | 190 | 210.0 | 227.5 | 206 | 4 | 8118.5 |

*The axis-axis distance and halfway-halfway distance between roll No. 1 and roll No. 2, for instance, are respectively given in the line for roll No. 2.

Meanwhile, when the guide roll pair roll axis-to-axis distance is gradually increased or decreased and when the region of guide roll pairs in which the roll axis-to-axis distance is varied is long in the direction of casting, for example when the distance is gradually increased in a continuous manner, the guide roll pair roll axis-to-axis distance and roll halfway-to-halfway distance values may become excessively large, so that the extent of slab bulging may become excessive and the molten steel level fluctuation preventing effect may thus decrease in certain instances. When, conversely, the distance is continuously decreased, the guide roll pair roll axis-to-axis distance and roll halfway-to-halfway distance values may become excessively small, so that it may become impossible to dispose spray nozzles for cooling the slab surface in some cases.

Therefore, in cases where the region of guide roll pairs in which the roll axis-to-axis distance should be varied is long in the direction of casting, it is recommended that the axis-to-axis distance value of first guide roll pair in a group of consecutive guide roll pairs be once put back to a value between the axis-to-axis distance value of the first guide roll pair and the axis-to-axis distance value of the last guide roll pair in a former group of consecutive guide roll pairs.

EXAMPLES

A slab 90 mm in thickness and 1,000 mm in width was cast using the above-mentioned vertical bending type continuous casting machine with a vertical length of 1.5 m and a bending radius of 3.5 m.

In each test run, the magnitude of molten steel level fluctuations was measured using an ordinary eddy current level sensor during casting of about 80 tons per heat. When the amplitude of periodic molten steel level fluctuations reached ±10 mm or higher during the run, the casting speed was decreased and the casting was continued. When the molten steel level fluctuations subsided following the reduction in casting speed, the casting speed was returned, about 5 minutes thereafter, to the intended level. Thereafter, when the molten steel level fluctuations in the mold again became great, the casting speed was again reduced. Such operation was repeated and the number of repetitions was examined and expressed as the frequency of occurrence of molten steel level fluctuations.

Further, using a 10-m long slab obtained in each casting test a strip with a thickness of 3.2 mm was produced by hot rolling and taken up in a coil form. This coil was pickled and then observed for surface condition and examined for the presence or absence of transverse surface defects (slivers) supposedly caused by longitudinal cracks on the slab. The ratio of the total length of sliver-presenting portions to the total coil length was determined and recorded as the sliver occurrence percentage of the coil.

Example 1

Peritectic steel with a C content of 0.10% by mass was cast at a speed of 3.5 m/min.

In the example according to the invention, namely Test No. 1, the roll axis-to-axis distances and roll halfway-to-halfway distances for the rolls on the fixed side and loose side of the four guide roll pairs from No. 6 to No. 9 were given values differing by 5.0 mm from one another, as shown in Table 2. The position of the No. 9 guide roll pair was about 2.5 m from the meniscus in the mold. The roll axis-to-axis distances and roll halfway-to-halfway distances for the other rolls were allowed to be equal to one another according to the circumstances.

In Test No. 2 to serve as a comparative example, the roll axis-to-axis distances and roll halfway-to-halfway distances for the rolls on the fixed side and loose side of the guide roll pairs from No. 6 to No. 9 were all given the same value of 175 mm. The roll axis-to-axis distances and roll halfway-to-halfway distances for the other rolls were allowed to be equal to one another according to the circumstances.

In Test No. 3 for comparison, the roll axis-to-axis distances for the rolls on the fixed side and loose side of the guide roll pairs No. 6 to No. 9 were given different values for roll disposition in an asymmetrical manner between the fixed side and loose side, while the roll halfway-to-halfway distances were all equal to the same value of 175 mm. The roll axis-to-axis distances and roll halfway-to-halfway distances for the other rolls were allowed to be equal to one another according to the circumstances.

In Test No. 4 for comparison, the roll disposition was such that the roll axis-to-axis distances for the rolls on the fixed side and loose side of the guide roll pairs No. 6 to No. 9 were given different values for roll disposition in an asymmetrical manner between the fixed side and loose side but, among the total of ten fixed side and loose side roll axis-to-axis and roll halfway-to-halfway distance values for the consecutive four guide rolls No. 6 to No. 9, there were the same distances having the value of 165 mm, 175 mm or 185 mm. The roll axis-to-axis distances and roll halfway-to-halfway distances for the other rolls were allowed to be equal to one another according to the circumstances.

TABLE 2

| | Test No. | Guide roll No. | Fixed side rolls (mm) Roll diameter | Axis-axis distance* | Halfway-halfway distance* | p value | α value | Loose side rolls (mm) Roll diameter | Axis-axis distance* | Halfway-halfway distance* | p value | α value |
|---|---|---|---|---|---|---|---|---|---|---|---|---|
| Invention | 1 | 6 | 120 | — | — | — | — | 120 | — | — | — | — |
| | | 7 | 120 | 170.0 | 172.5 | 160 | 5 | 120 | 182.0 | 179.5 | 152 | 5 |
| | | 8 | 120 | 175.0 | 177.5 | 160 | 5 | 120 | 177.0 | 174.5 | 152 | 5 |
| | | 9 | 120 | 180.0 | 182.5 | 160 | 5 | 120 | 172.0 | 169.5 | 152 | 5 |
| For comparison | 2 | 6 | 120 | 175.0 | 175.0 | — | — | 120 | 175.0 | 175.0 | — | — |
| | | 7 | 120 | 175.0 | 175.0 | — | — | 120 | 175.0 | 175.0 | — | — |
| | | 8 | 120 | 175.0 | 175.0 | — | — | 120 | 175.0 | 175.0 | — | — |
| | | 9 | 120 | 175.0 | 175.0 | — | — | 120 | 175.0 | 175.0 | — | — |
| | 3 | 6 | 120 | 165.0 | 175.0 | — | — | 120 | 185.0 | 175.0 | — | — |
| | | 7 | 120 | 185.0 | 175.0 | — | — | 120 | 165.0 | 175.0 | — | — |
| | | 8 | 120 | 165.0 | 175.0 | — | — | 120 | 185.0 | 175.0 | — | — |
| | | 9 | 120 | 185.0 | 175.0 | — | — | 120 | 165.0 | 175.0 | — | — |
| | 4 | 6 | 120 | 165.0 | 165.0 | — | — | 120 | 165.0 | 165.0 | — | — |
| | | 7 | 120 | 165.0 | 165.0 | — | — | 120 | 185.0 | 175.0 | — | — |
| | | 8 | 120 | 185.0 | 175.0 | — | — | 120 | 185.0 | 185.0 | — | — |
| | | 9 | 120 | 165.0 | 175.0 | — | — | 120 | 165.0 | 175.0 | — | — |

*The axis-axis distance and halfway-halfway distance between roll No. 6 and roll No. 7, for instance, are respectively given in the line for roll No. 7.

In Test No. 1, molten steel level fluctuations occurred only to a slight extent with an amplitude of about ±3 mm in the vertical direction and no periodic molten steel level fluctuations occurred. The sliver occurrence percentage of the hot rolling product coil was as low as 0.3%. A good quality coil was thus obtained.

In Test No. 2, Test No. 3 and Test No. 4, the frequency of occurrence of molten steel level fluctuations was 6 to 8 times and, when intense period molten steel level fluctuations of about +7.5 to +10 mm occurred, it was necessary to reduce the casting speed to 2 m/min or lower. Otherwise, molten steel level fluctuations became greater, making it difficult to continue the casting. The sliver occurrence percentages of the hot rolling product coils were as high as 4.3 to 4.5%; slivers caused by mold powder trapping occurred.

Example 2

Peritectic steel with a C content of 0.10% by mass was cast at a speed of 3.5 m/min.

In the example according to the invention, namely Test No. 5, the roll axis-to-axis distances and roll halfway-to-halfway distances for the rolls on the fixed side and loose side of the guide roll pairs from No. 6 to No. 12 were given values different from one another, as shown in Table 3. The roll axis-to-axis distances and roll halfway-to-halfway distances for the other rolls were allowed to be equal to one another according to the circumstances.

In another example according to the invention, namely Test No. 6, the roll axis-to-axis distances and roll halfway-to-halfway distances for the guide roll pairs No. 6 to No. 9 were given values different from one another and, further, the roll axis-to-axis distances and roll halfway-to-halfway distances for the guide roll pairs No. 10 to No. 12 were partly given the same values as those for the guide roll pairs No. 6 to No. 9, as shown in Table 3. The roll axis-to-axis distances and roll halfway-to-halfway distances for the other rolls were allowed to be equal to one another according to the circumstances.

In Test No. 7 for comparison, all the roll axis-to-axis distances and roll halfway-to-halfway distances on the fixed side and loose side for the guide roll pairs No. 6 to No. 12 were given the same value of 175 mm. The roll axis-to-axis distances and roll halfway-to-halfway distances for the other rolls were given arbitrary values.

In Test No. 5 and Test No. 6, only molten steel level fluctuations of small magnitude of about ±2 to ±3 mm occurred and no periodical molten steel level fluctuations occurred. The sliver occurrence percentages of the hot rolling product coils were as low as 0.1% to 0.2%. Good quality coils were thus obtained.

In Test No. 7, the frequency of molten steel level fluctuations was 6 times and, when great periodical molten steel fluctuations of about ±5 to ±10 mm occurred, it was necessary to reduce the casting speed to 2 m/min or lower; otherwise, the molten steel level fluctuations became greater, making it difficult to continue the casting. The sliver occurrence percentage of the hot rolling product coil was as high as 3.8%; slivers caused by mold powder trapping occurred.

TABLE 3

| | Test No. | Guide roll No. | Fixed side rolls (mm) Roll diameter | Axis-axis distance* | Halfway-halfway distance* | p value | α value | Loose side rolls (mm) Roll diameter | Axis-axis distance* | Halfway-halfway distance* | p value | α value |
|---|---|---|---|---|---|---|---|---|---|---|---|---|
| Invention | 5 | 6 | 120 | — | — | — | — | 120 | — | — | — | — |
| | | 7 | 120 | 170.0 | 172.5 | 160 | 5 | 120 | 182.0 | 179.5 | 152 | 5 |
| | | 8 | 120 | 175.0 | 177.5 | 160 | 5 | 120 | 177.0 | 174.5 | 152 | 5 |
| | | 9 | 120 | 180.0 | 182.5 | 160 | 5 | 120 | 172.0 | 169.5 | 152 | 5 |
| | | 10 | 120 | 185.0 | 187.5 | 160 | 5 | 120 | 167.0 | 164.5 | 152 | 5 |

TABLE 3-continued

| | Test No. | Guide roll No. | Fixed side rolls (mm) Roll diameter | Axis-axis distance* | Halfway-halfway distance* | p value | α value | Loose side rolls (mm) Roll diameter | Axis-axis distance* | Halfway-halfway distance* | p value | α value |
|---|---|---|---|---|---|---|---|---|---|---|---|---|
| | | 11 | 120 | 190.0 | 192.5 | 160 | 5 | 120 | 162.0 | 159.5 | 152 | 5 |
| | | 12 | 120 | 195.0 | 180.5 | 160 | 5 | 120 | 157.0 | 171.5 | 152 | 5 |
| Invention | 6 | 6 | 120 | 165.0 | 167.5 | 160 | 5 | 120 | 187.0 | 184.5 | 152 | 5 |
| | | 7 | 120 | 170.0 | 172.5 | 160 | 5 | 120 | 182.0 | 179.5 | 152 | 5 |
| | | 8 | 120 | 175.0 | 177.5 | 160 | 5 | 120 | 177.0 | 174.5 | 152 | 5 |
| | | 9 | 120 | 180.0 | 182.5 | 160 | 5 | 120 | 172.0 | 169.5 | 152 | 5 |
| | | 10 | 120 | 185.0 | 180.0 | — | — | 120 | 167.0 | 171.0 | — | — |
| | | 11 | 120 | 175.0 | 175.0 | — | — | 120 | 175.0 | 175.0 | — | — |
| | | 12 | 120 | 175.0 | 175.0 | — | — | 120 | 175.0 | 175.0 | — | — |
| For comparison | 7 | 6 | 120 | 160.0 | 167.5 | — | — | 120 | 160.0 | 167.5 | — | — |
| | | 7 | 120 | 175.0 | 175.0 | — | — | 120 | 175.0 | 175.0 | — | — |
| | | 8 | 120 | 175.0 | 175.0 | — | — | 120 | 175.0 | 175.0 | — | — |
| | | 9 | 120 | 175.0 | 175.0 | — | — | 120 | 175.0 | 175.0 | — | — |
| | | 10 | 120 | 175.0 | 175.0 | — | — | 120 | 175.0 | 175.0 | — | — |
| | | 11 | 120 | 175.0 | 175.0 | — | — | 120 | 175.0 | 175.0 | — | — |
| | | 12 | 120 | 175.0 | 175.0 | — | — | 120 | 175.0 | 175.0 | — | — |

*The axis-axis distance and halfway-halfway distance between roll No. 6 and roll No. 7, for instance, are respectively given in the line for roll No. 7.

Example 3

Low-carbon aluminum-killed steel with a C content of 0.05% by mass was cast at a speed of 5 m/min.

In this example of the invention, namely Test No. 8, the guide roll pair roll disposition shown above in Table 1 was employed.

In Test No. 9 for comparison, the roll axis-to-axis distances and roll halfway-to-halfway distances for the guide roll pairs No. 1 to No. 7 occurring from just below the mold bottom and in the vertical section and the guide roll pairs No. 8 to No. 14 occurring in the bending section were all given the same value of 177 mm, as shown in Table 4. The disposition of the other guide roll pair rolls were the same as in Test No. 1.

In Test No. 8, only molten steel level fluctuations of small magnitude of about ±2 mm occurred and no periodic molten steel level fluctuations occurred. The sliver occurrence percentage of the hot rolling product coil was as low as 0.1% A good quality coil was thus obtained.

In Test No. 9, the frequency of molten steel level fluctuations was 6 times and, when great periodic molten steel fluctuations of about ±5 to ±10 mm occurred, it was necessary to reduce the casting speed to 3 m/min or lower; otherwise, the molten steel level fluctuations became greater, making it difficult to continue the casting. The sliver occurrence percentage of the hot rolling product coil was as high as 2.6%; namely, slivers caused by mold powder trapping occurred.

TABLE 4

| | Test No. | Guide roll No. | Fixed side rolls (mm) Roll diameter | Axis-axis distance* | Halfway-halfway distance* | p value | α value | Loose side rolls (mm) Roll diameter | Axis-axis distance* | Halfway-halfway distance* | p value | α value |
|---|---|---|---|---|---|---|---|---|---|---|---|---|
| For comparison | 9 | 1 | 110 | — | — | — | — | 110 | — | — | — | — |
| | | 2 | 120 | 177.0 | 177.0 | — | — | 120 | 177.0 | 177.0 | — | — |
| | | 3 | 120 | 177.0 | 177.0 | — | — | 120 | 177.0 | 177.0 | — | — |
| | | 4 | 120 | 177.0 | 177.0 | — | — | 120 | 177.0 | 177.0 | — | — |
| | | 5 | 120 | 177.0 | 177.0 | — | — | 120 | 177.0 | 177.0 | — | — |
| | | 6 | 120 | 177.0 | 177.0 | — | — | 120 | 177.0 | 177.0 | — | — |
| | | 7 | 120 | 177.0 | 177.0 | — | — | 120 | 177.0 | 177.0 | — | — |
| | | 8 | 120 | 177.0 | 177.0 | — | — | 120 | 177.0 | 177.0 | — | — |
| | | 9 | 120 | 177.0 | 177.0 | — | — | 120 | 177.0 | 177.0 | — | — |
| | | 10 | 120 | 177.0 | 177.0 | — | — | 120 | 177.0 | 177.0 | — | — |
| | | 11 | 120 | 177.0 | 177.0 | — | — | 120 | 177.0 | 177.0 | — | — |
| | | 12 | 120 | 177.0 | 177.0 | — | — | 120 | 177.0 | 177.0 | — | — |
| | | 13 | 120 | 177.0 | 177.0 | — | — | 120 | 177.0 | 177.0 | — | — |
| | | 14 | 120 | 177.0 | 177.75 | — | — | 120 | 177.0 | 178.3 | — | — |

*The axis-axis distance and halfway-halfway distance between roll No. 1 and roll No. 2, for instance, are respectively given in the line for roll No. 2.

What is claimed is:

1. A machine for continuous casting of steel, which comprises a plurality of opposed slab-supporting guide rolls arranged in pairs disposed in the region in which a liquid core exists within the slab withdrawn from the mold, wherein at least four consecutive guide roll pairs are disposed under such conditions that the roll axis-to-axis distances of adjacent roll pairs on a fixed side and the roll axis-to-axis distances of adjacent roll pairs on a loose side of the guide roll pairs and the roll halfway-to-halfway distances between adjacent roll pairs on the fixed side and loose side, respectively, as determined in the direction of casting, are all different from one another.

2. A machine as claimed in claim 1, wherein at least four consecutive guide roll pairs are disposed under such conditions that the. roll axis-to-axis distances of adjacent roll pairs on the fixed side of the guide roll pairs progressively increase from the upstream side to the downstream side in the direction of the casting while the roll axis-to-axis distances of adjacent roll pairs on the loose side progressively decrease, or under such conditions that the roll axis-to-axis distances on the fixed side progressively decrease while the roll axis-to-axis distances of adjacent roll pairs on the loose side progressively increase.

3. A method for continuous casting of steel, comprising the steps of:

providing a plurality of slab-supporting guide rolls disposed in opposed pairs in longitudinally spaced array from about the bottom of a casting mold along a length of a cast product in which steel within a core thereof is liquid; and disposing at least four consecutive pairs of opposed guide rolls in positions in which the roll axis-to-axis distances between adjacent roll pairs on a fixed side and on a loose side of the guide roll pairs and roll halfway-to-halfway distances between adjacent roll pairs on the fixed and loose sides are all different from one another.

4. The method as claimed in claim 3, wherein, with respect to said at least four consecutive guide roll pairs, the roll axis-to-axis distances of adjacent roll pairs on the fixed side of the guide roll pairs progressively increase from the upstream side to the downstream side in the direction of casting while the roll axis-to-axis distances on the loose side progressively decrease, or the roll axis-to-axis distances of adjacent roll pairs on the fixed side progressively decrease while the roll axis-to-axis distances of adjacent roll pairs on the loose side progressively increase.

5. The method as claimed in claim 4, wherein, with respect to consecutive guide roll pairs, in progressively increasing or decreasing the roll axis-to axis distance between adjacent roll pairs on the fixed side or the loose side of the guide roll pairs, the axis-to-axis distance of the first guide roll pair in a group of consecutive guide roll pairs is put back to a value between the axis-to-axis distance of the last guide roll pair in a former group of consecutive guide roll pairs.

6. The method as claimed in claim 3, wherein the steel is low-carbon aluminum-killed steel with a C content of less than 0.07% by mass or peritectic steel with a C content of 0.07% to 0.18% by mass.

7. The method as claimed in claim 4, wherein the steel is low-carbon aluminum-killed steel with a C content of less than 0.07% by mass or peritectic steel with a C content of 0.07% to 0.18% by mass.

8. The method as claimed in claim 5, wherein the steel is low-carbon aluminum-killed steel with a C content of less than 0.07% by mass or peritectic steel with a C content of0.07% to 0.18% by mass.

9. The method as claimed in claim 3, wherein the steel is cast into a slab with a thickness of 50 mm to 120 mm.

10. The method as claimed in claim 4, wherein the steel is cast into a slab with a thickness of 50 mm to 120 mm.

11. The method as claimed in claim 5, wherein the steel is cast into a slab with a thickness of 50 mm to 120 mm.

12. The method as claimed in claim 6, wherein the steel is cast into a slab with a thickness of 50 mm to 120 mm.

13. The method as claimed in claim 7, wherein the steel is cast into a slab with a thickness of 50 mm to 120 mm.

14. The method as claimed in claim 8, wherein the steel is cast into a slab with a thickness of 50 mm to 120 mm. direction of the casting while the roll axis-to-axis distances on the loose side gradually decrease, or under such conditions that the roll axis-to-axis distances on the loose side gradually increase.

* * * * *